US006618021B1

(12) United States Patent
Keith et al.

(10) Patent No.: US 6,618,021 B1
(45) Date of Patent: Sep. 9, 2003

(54) ELECTRICALLY SMALL APERTURE ANTENNAE WITH FIELD MINIMIZATION

(75) Inventors: Alan R. Keith, Fullerton, CA (US); Robert L. Reynolds, Newbury Park, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/170,119

(22) Filed: Jun. 12, 2002

(51) Int. Cl.[7] ..... H01Q 13/00
(52) U.S. Cl. ..... 343/772; 343/786; 343/DIG. 2
(58) Field of Search ..... 343/772, 773, 343/786, DIG. 2

(56) References Cited

U.S. PATENT DOCUMENTS 5,461,394 A * 10/1995 Weber ..... 343/786
5,552,797 A * 9/1996 Cook ..... 343/786
6,208,309 B1 * 3/2001 Chandler et al. ..... 343/786
6,208,310 B1 * 3/2001 Suleiman et al. ..... 343/786

* cited by examiner

*Primary Examiner*—Hoang Nguyen
(74) *Attorney, Agent, or Firm*—Terje Gudmestad, Esq.; Artz & Artz, P.C.

(57) ABSTRACT

A satellite assembly 10 is provided, including an RF radiating element 12 including a plurality of RF choke elements 18, each of said plurality of RF choke elements 18 being defined by an RF dimensional set 20 including an RF depth 22 and an RF width 24. The satellite assembly 10 further includes a null aperture field zone 26 created by the plurality of RF choke elements 18, the null aperture field zone 26 created by tuning each of the RF dimensional sets 20. At least one field sensitive component 14 is positioned within said null aperture field zone 26.

22 Claims, 3 Drawing Sheets

ELECTRICALLY SMALL APERTURE ANTENNAE WITH FIELD MINIMIZATION

STATEMENT OF RIGHTS OWNED

This invention was made with Government support. The Government has certain rights in this invention.

TECHNICAL FIELD

The present invention relates generally to an electrically small aperture antenna with field minimization capabilities, and more particularly to a satellite antenna system wherein protected devices may be placed at the null location created by the field minimized antenna.

BACKGROUND OF THE INVENTION

Satellite technology has long dictated that advancements in performance, function, and capabilities must be balanced by size and weight restrictions. This need to integrate form and function has led to a variety of advancements and continues to spur the development of further advancements. One subfield of satellite technology driven by such design characteristics has been the subfield of satellite antennae design. Multiple antennae arrays must often be utilized on a single satellite assembly in order to provide desired functionality. Size and weight restrictions on the satellite assembly often dictate that the multiple antennae arrays must be positioned within close proximity to each other. Design complications arise, however, when the proximity of such satellite arrays causes interference between individual antennae arrays and other field sensitive units within the satellite system.

One approach towards limiting the effect of an antennae array on surrounding components has been through the use of RF chokes. RF chokes are commonly corrugations around the perimeter of the antennae aperture utilized to suppress currents from promulgating past the aperture bore sight axis. The RF chokes are commonly used to suppress side lobes by reducing the current on the backside of the antennae aperture flanges. The depth of the RF choke is commonly set near a quarter wavelength deep and the amount of side lobe reduction is commonly limited by the allowable width of the choke. Although these known configurations can reduce in side lobe reduction, they leave considerable room for improvement in interference reduction between antennae arrays and other hardware.

Although present RF choke design is commonly configured to result in side lobe reduction, the current suppression provided by such designs commonly allow aperture fields to promulgate and cause interference with surrounding components. Sensors, receiving antennas, and imagers can all be negatively impacted by the aperture field promulgating from the antennae. Although overall reduction of the aperture field may be beneficial for the overall satellite design, specific components may require further field reduction as their mounting position on the satellite assembly. It would, therefore, be highly beneficial to have an antennae assembly whose design could be modified such that the aperture fields created by the antennae assembly could be minimized in locations where critical components are mounted. Since packaging requirements on the satellite system are often highly restrictive, such an antennae design would provide valuable placement freedom for such critical components.

Additionally, sizing, packaging, and weight restrictions inherent in satellite design dictate that a compact antennae design capable of minimizing the aperture field in locations of critical component placement would also be highly desirable.

SUMMARY OF THE INVENTION

It is, therefore, an object of the present invention to provide a satellite assembly including an aperture antennae configured to minimize the aperture field near a field sensitive component. It is a further object of the present invention to provide an aperture antennae with field minimization characteristics. The aperture antennae having a compact design.

In accordance with the objects of the present invention, a satellite assembly is provided. The satellite assembly includes an aperture antennae assembly including a plurality of RF choke elements. Each of the RF chokes is defined by an RF dimensional set which includes an RF width and an RF depth. The RF dimensional sets for each of the RF chokes are varied such that the plurality of RF choke elements create a null aperture field zone. The satellite assembly further includes at least one field sensitive component positioned in the null aperture field zone.

Other objects and features of the present invention will become apparent when viewed in light of the detailed description of the preferred embodiment when taken in conjunction with the attached drawings and appended claims.

DESCRIPTION OF THE PREFERRED EMBODIMENTS

Figure 1:
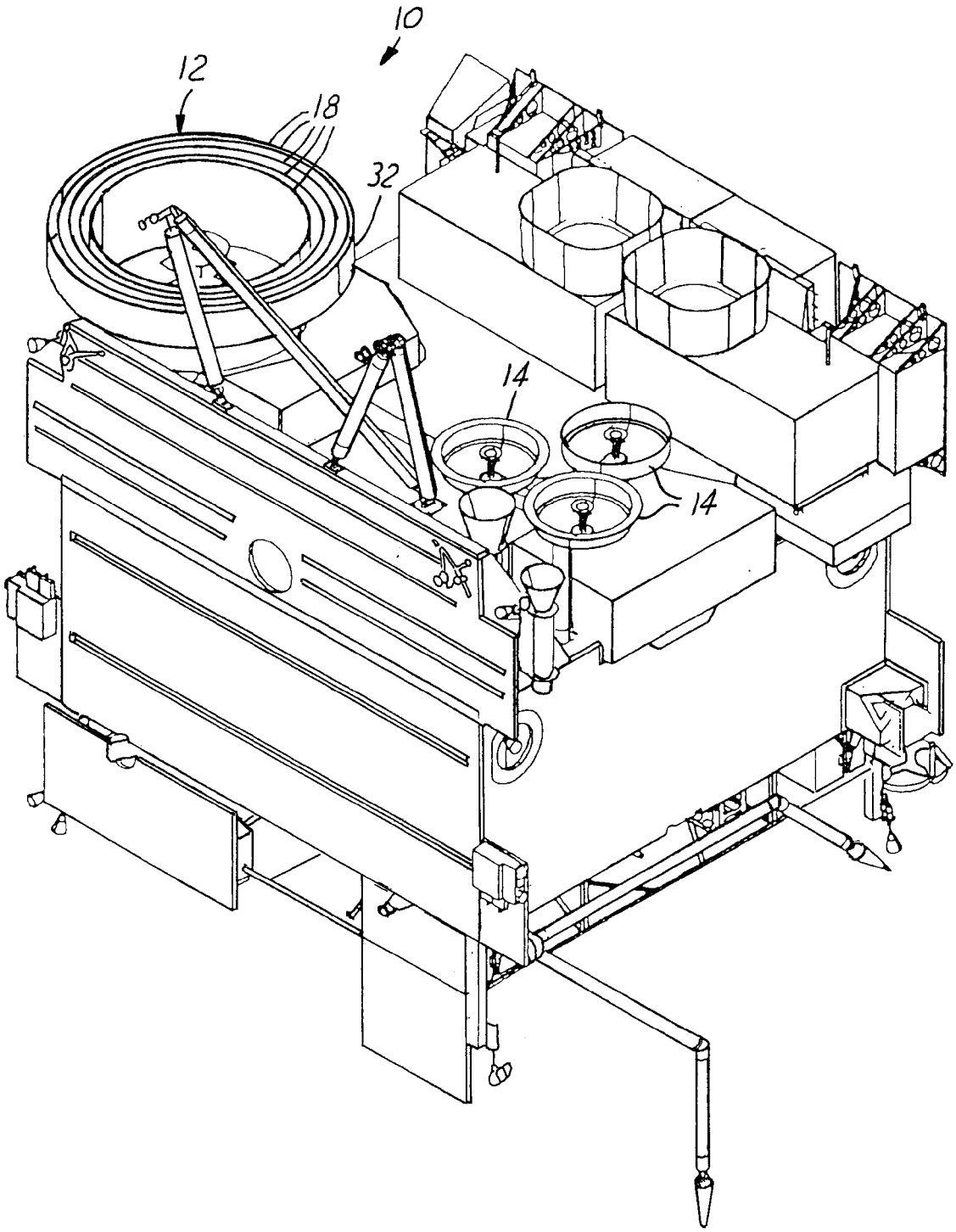
FIG. 1 is an illustration of an embodiment of a satellite assembly in accordance with the present invention.

Referring now to FIG. 1, which is an illustration of a satellite assembly in accordance with the present invention. The satellite assembly 10 is illustrated as a GOES style satellite. Although a GOES satellite has been utilized for illustrative purposes, it should be understood that the present invention may be utilized on a wide variety of satellite assemblies and for an even wider variety of individual applications. The satellite assembly 10 includes an RF radiating element 12. Although a wide variety of RF radiating elements 12 are contemplated by the present invention, the RF radiating element 12 is illustrated as an aperture antenna. Electrically small aperture antennas, such as the UHF antenna commonly utilized on GOES style satellites, are known to produce RF radiation during operation. It is known that this radiation can interfere with the operation of some satellite systems and components.

One group of susceptible components are field sensitive components 14. Field sensitive components 14 can be susceptible to the sidelobe RF radiation created by the RF radiating element 12, such as the GOES UHF antenna. Although a wide variety of field sensitive components 14 are contemplated by the present invention, the field sensitive components 14 illustrated in FIG. 1 are intended to represent IR sounder/imagers 14 often utilized in GOES satellite designs. These IR sounder/imagers 14 are known to be sensitive to RF radiation present in the DSC downlink at 468.8 Mhz for example. Although a particular component and application sensitivity have been mentioned for illustrative purposes, it should be understood that a wide variety of specific field sensitive components 14 and application-specific sensitivities are contemplated. It is therefore desirable to position the field sensitive components 14 in a position within the satellite assembly 10 where there is low sidelobe generation. Packaging considerations and design limitations, however, can place considerable restraints on the repositioning of such field sensitive components 14 into areas with naturally occurring sidelobe reductions. Furthermore, naturally occurring sidelobe reductions may be insufficient to accommodate many field sensitive components 14.

Figure 2:
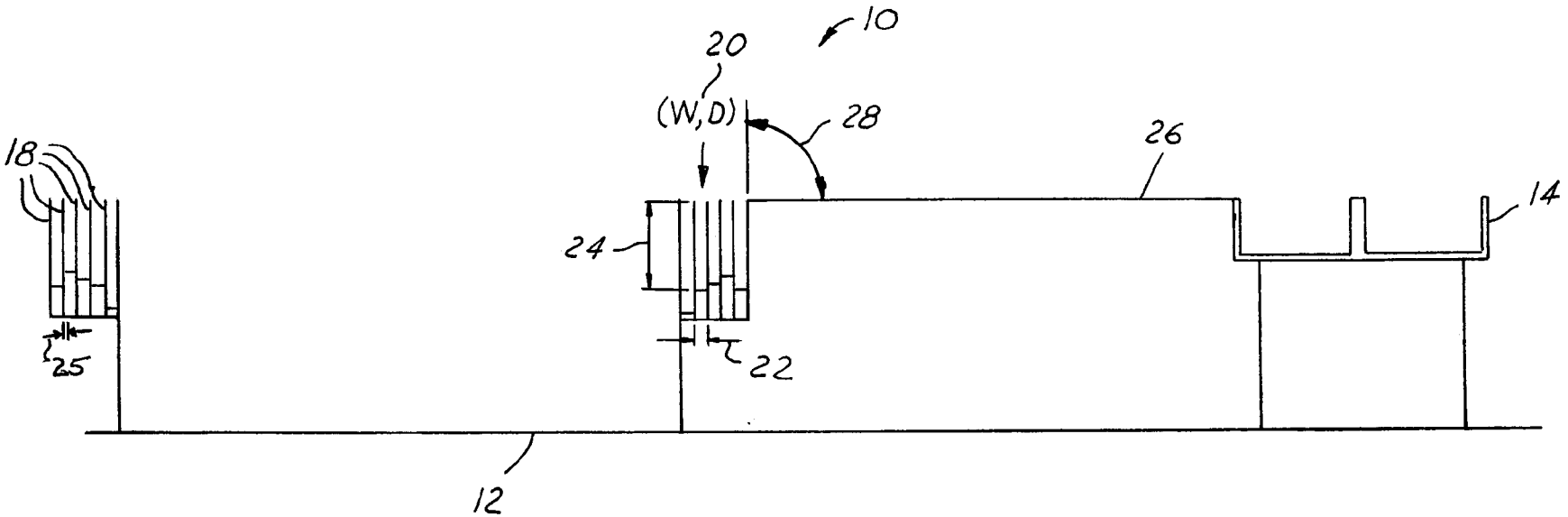
FIG. 2 is cross-sectional illustration of a portion of the satellite assembly illustrated in FIG. 1.

The present invention addresses this problem by reducing the sidelobe RF production at the design location of field sensitive components 14. This is accomplished through the use of a plurality of RF choke elements 18 (see FIG. 2). It is contemplated that the plurality of RF choke elements 18 can comprise any number N of individual RF choke elements. Each of the plurality of RF choke elements 18 is defined by an RF dimensional set 20. Each RF dimensional set 20 includes an RF width 22 and an RF depth 24. Additional dimensional characteristics such as the RF wall thickness 25 may be utilized to define the plurality of RF choke elements 18 in addition to those described. The RF dimensional set 20 for each of the plurality of RF choke elements 18 are tuned such that the plurality of RF choke elements 18 work together to form a null aperture field zone 26. The null aperture field zone 26 is intended to represent any dimensionally or directionally defined region of the satellite assembly 10 wherein the RF sidelobe production created by the RF radiating element 12 is minimized. By adjusting the RF dimensional set 20 for each of the plurality of RF choke elements 18 independently, the plurality of RF choke elements 18 can be tuned as a whole such that the null aperture field zone 26 is positioned properly over the field sensitive components 14. In this fashion, an improved satellite assembly 10 is provided wherein design and packaging considerations can dictate the placement of the field sensitive components 14 rather than dictating placement by natural field minimization locations. In addition to modification of the RF dimensional sets 20, the number of N of RF choke elements can also be varied to provide additional control over the positioning of the null aperture field zone 26.

Figure 3:
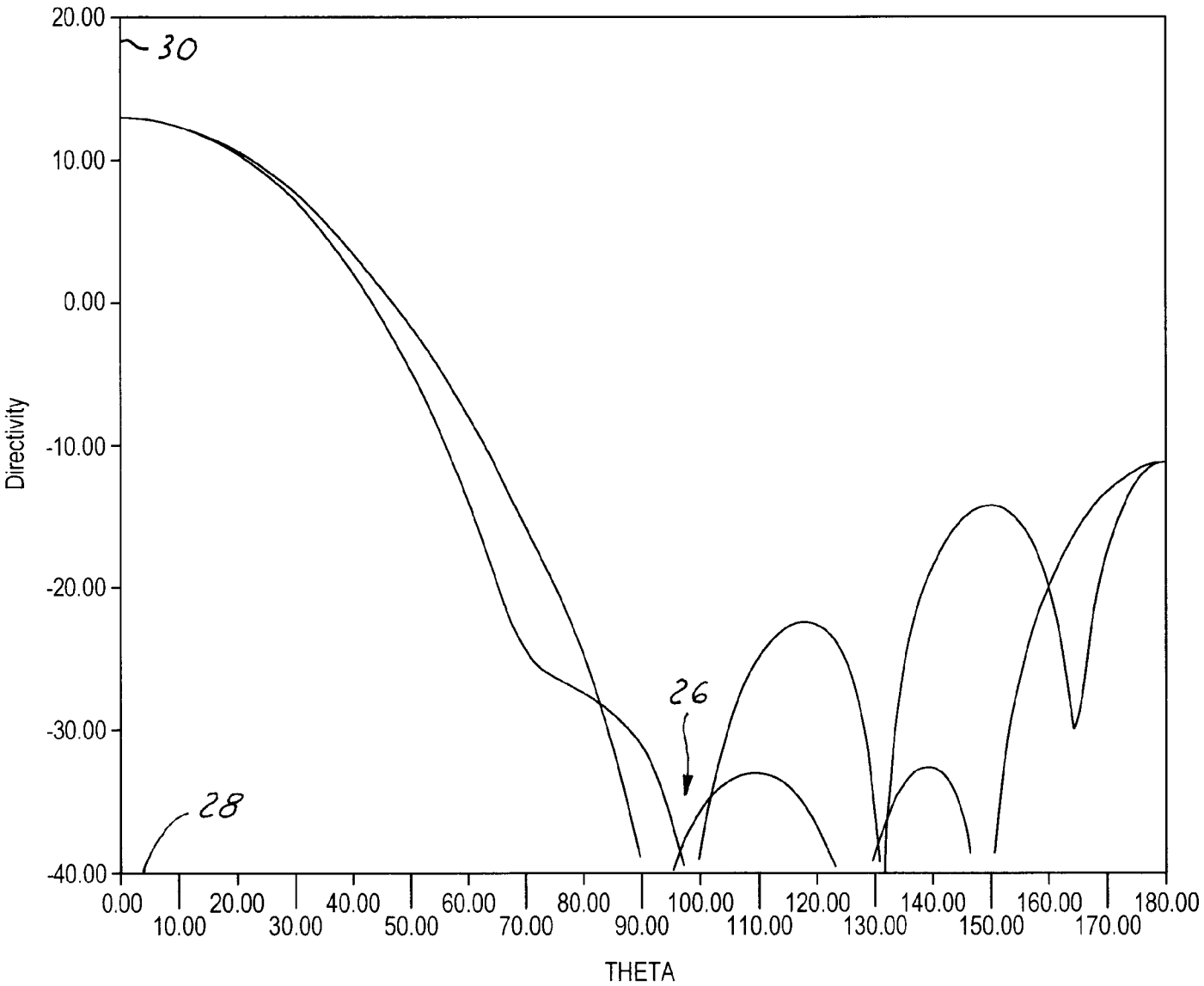
FIG. 3 is a graph illustrating the null aperture field zone created by the plurality of RF chokes in accordance with the present invention.

Although the null aperture field zone 26 is intended to represent any dimensionally or directionally defined area (normally 90° from antennae bore sight) in one embodiment the null aperture field zone 26 is defined by the placement angle 28 defined by the angle from the bore sight axis of the aperture antenna 12. The number N of RF choke elements along with the RF width 22 and RF depth 24 can be adjusted such that the null aperture field zone 26 can be tuned to a specific angle 28 suitable for placement of the field sensitive components 14. FIG. 3 is an illustration of a graph representing field strengths 30 in relation to placement angle 28. As can be visualized, the RF dimensional sets 20 were optimized to create a null aperture field zone 26 at approximately 90 degrees. It should be understood, however, that the RF dimensional sets 20 may be tuned to optimize any angle suitable for placement of the field sensitive components. Furthermore, although the results illustrated in FIG. 3 were taken from far-field measurements, the theory and results are equally applicable to near-field applications.

Although the number N of RF choke elements and the RF dimensional sets 20 may be adjusted in any number of fashions, in one embodiment the size of the aperture antenna 12 places size limitations on the procedure. In this particular embodiment it is contemplated that the outer diameter 32 of the aperture antenna 12 is fixed. The number N of RF choke elements, therefore, dictates the RF width 22 of each of the plurality of RF choke elements 18 when they are equally spaced. The RF depth 24 of each of the plurality of RF choke elements 18 is set preliminarily to a quarter wavelength in depth (i.e. a quarter wavelength of the desired suppressed wave). Then each of the plurality of RF choke elements 18 has its RF depth 24 individually adjusted until the plurality of RF choke elements 18 creates the desired null aperture field zone 26 for a specific application. In this fashion, for a given sized aperture antenna 12, the null aperture field zone 26 can be optimized for position and strength of reduction at the desired placement of field sensitive components 14.

While particular embodiments of the invention have been shown and described, numerous variations and alternative embodiments will occur to those skilled in the art. Accordingly, it is intended that the invention be limited only in terms of the appended claims.

What is claimed is:

1. A satellite assembly comprising:

an RF radiating element including a plurality of RF choke elements, each of said plurality of RF choke elements being defined by an RF dimensional set including an RF depth and an RF width;

a null aperture field zone created by said plurality of RF choke elements; said null aperture field zone created by tuning each of said RF dimensional sets; and at least one field sensitive component positioned within said null aperture field zone.

2. A satellite assembly as described in claim 1, wherein said tuning each of said RF dimensional sets comprises adjusting each of said RF depths.

3. A satellite assembly as described in claim 1, wherein said tuning each of said RF dimensional sets comprises adjusting each of said RF widths.

4. A satellite assembly as described in claim 1, wherein said RF dimensional set includes an RF wall thickness, and wherein said tuning of each of said RF dimensional sets comprises adjusting each of said RF wall thicknesses.

5. A satellite assembly as described in claim 1, wherein the number of said plurality of RF choke elements is adjusted to create said null aperture field zone.

6. A satellite assembly as described in claim 1, wherein each of said RF widths is a function of the number of said plurality of RF choke elements.

7. A satellite assembly as described in claim 1, wherein said null aperture field zone is defined by the placement angle of said at least one field sensitive component relative to said RF radiating element.

8. A satellite assembly as described in claim 1, wherein said RF radiating element is an aperture antenna.

9. A satellite assembly as described in claim 1, wherein said RF radiating element is a UHF antenna.

10. A satellite assembly as described in claim 1, wherein said at least one field sensitive component comprises at least one IR sounder/imager.

11. A satellite assembly comprising:

an aperture antenna including a number N of RF choke elements, each of said number N of RF choke elements being defined by an RF dimensional set including an RF depth and an RF width;

a null aperture field zone created by said number N of RF choke elements; said null aperture field zone adjusted by the quantity of said number N of RF choke elements and by tuning each of said RF dimensional sets; and at least one field sensitive component positioned within said null aperture field zone.

12. A satellite assembly as described in claim 11, wherein said tuning each of said RF dimensional sets comprises adjusting each of said RF depths.

13. A satellite assembly as described in claim 11, wherein said tuning each of said RF dimensional sets comprises adjusting each of said RF widths.

14. A satellite assembly as described in claim 11, wherein said RF dimensional set includes an RF wall thickness, and wherein said tuning of each of said RF dimensional sets comprises adjusting each of said RF wall thicknesses.

15. A satellite assembly as described in claim 11, wherein each of said RF widths is a function of said quantity of said number N of RF choke elements.

16. A satellite assembly as described in claim 11, wherein said null aperture field zone is defined by the placement angle of said at least one field sensitive component relative to said aperture antenna.

17. A satellite assembly as described in claim 11, wherein said aperture antenna is a UHF antenna.

18. A satellite assembly as described in claim 11, wherein said at least one field sensitive component comprises at least one IR sounder/imager.

19. A satellite assembly as described in claim 11, wherein each of said RF depths is set to a quarter wavelength prior to tuning.

20. A method of reducing the effects an RF radiating element, including a plurality of RF choke elements, on a field sensitive component comprising:

tuning the RF depth of each of said plurality of RF choke elements such that the plurality of RF choke elements create a null aperture field zone that coincides with the placement of a field sensitive component.

21. A method as described in claim 20, further comprising:

adjusting the number of said plurality of RF choke elements such that said null aperture field zone coincides with the placement of said field sensitive component.

22. A method as described in claim 20, further comprising:

tuning the RF width of each of said plurality of RF choke elements such that the plurality of RF choke elements create a null aperture field zone that coincides with the placement of a field sensitive component.

* * * * *